United States Patent [19]

Meredith

[11] Patent Number: 4,886,024

[45] Date of Patent: Dec. 12, 1989

[54] ROTARY PISTON ENGINE

[76] Inventor: Harold M. Meredith, 841 N. Homer Rd., Midland, Mich. 48640

[21] Appl. No.: 200,570

[22] Filed: May 31, 1988

Related U.S. Application Data

[63] Continuation-in-part of Ser. No. 878,111, Jun. 24, 1986, abandoned.

[51] Int. Cl.[4] ..... F02B 53/04

[52] U.S. Cl. ..... 123/234; 123/58 B; 417/271

[58] Field of Search ..... 123/224, 234, 58 B, 123/188 C; 417/271

[56] References Cited

U.S. PATENT DOCUMENTS

| | | | |
|---|---|---|---|
| 1,245,154 | 11/1917 | Faessler | 123/223 |
| 2,052,765 | 9/1936 | Hatfield | 123/223 |
| 2,084,923 | 6/1937 | Sopher | 123/224 |
| 2,159,544 | 5/1939 | Bartlett et al. | 123/224 |
| 3,073,118 | 1/1963 | August | 123/224 |
| 3,385,051 | 5/1968 | Kelly | 123/58 AM |
| 4,515,113 | 5/1985 | DeLorean | 123/58 B |
| 4,553,513 | 11/1985 | Miles et al. | 123/234 |
| 4,617,886 | 10/1986 | Mach | 123/223 |

FOREIGN PATENT DOCUMENTS

| | | | |
|---|---|---|---|
| 0115822 | 9/1981 | Japan | 123/223 |
| 568367 | 3/1945 | United Kingdom | 123/224 |

*Primary Examiner*—David A. Okonsky

*Attorney, Agent, or Firm*—Remy J. VanOphem

[57] ABSTRACT

A rotary piston engine energizable by internal combustion having an engine assembly whereby expansion of gas for driving the engine occurs on the outer circumference of at least one rotary disc element in the engine assembly and generated power is taken and exerted at a place that is relatively distant from the axis of a main drive shaft incorporated in the engine assembly so as to allow maximum torque generation in and by the apparatus even when operating at relatively low rates of rotation.

18 Claims, 4 Drawing Sheets

ROTARY PISTON ENGINE

CROSS-REFERENCE TO RELATED APPLICATIONS

This application is a continuation-in-part of Ser. No. 878,111, filed June 24, 1986, now abandoned.

BACKGROUND OF THE INVENTION

1. Field of the Invention

The present invention pertains to improvements in rotary piston engines or motors powered by internal combustion procedures.

2. Description of the Prior Art

The evolution of modern internal combustion powered engines and motors is well known. The commencement thereof is many years past and the improvements upon original pioneering concepts and implementations has been constantly continuing since their inception.

A great proportion of, and a most significant thrust in, these developments has been towards engine adaptation of the conventional piston type with powering expansion by fuel combustion of an energizing medium suitable for the purpose of providing an explosive force to drive the movable piston within a plane of reciprocation, wherein an eccentric mechanism, such as a crankshaft, is furnished and so adapted as to be capable of converting reciprocating force and energy into rotary motive power of one or another sort.

Efforts have been made to make internal combustion engines and motors of a rotary configuration because of a perceived maximization of efficiencies with respect to function, performance and fuel consumption.

In all of this, it has indeed been observed and recognized that insofar as concerns the obtention of maximized work output efficiency in a so-called four stroke cycle there is continued need for compression patterns in gas engines and the like according to the now old expressions that Beau de Rochas first expressed in 1864. These classical rules of thumb are still appropriately applicable in presett day engines of various sorts, including the rotary type, and set forth clearly that: (i) there should be a maximum of cylinder volume per unit of cylinder surface; (ii) expansion should occur with maximum rapidity; (iii) there should be a maximum ratio of expansion; and (iv) there should be a maximum initial pressure.

In any event, many of the contemplated as well as actually employed rotary style engines did not prove successful nor find much practicality or applicability for actual use and installation.

Indicative and rather typical of the more-or-less impractical early types of rotary engines are those shown in U.S. Pat. No. 937,298 granted Oct. 19, 1909 to one A. Finch for a "REVERSIBLE GAS OR OIL ENGINE"; U.S. Pat. No. 1,272,728 granted July 18, 1918, to W. J. Tower for a "ROTARY ENGINE"; U.S. Pat. No. 1,286,900 granted Dec. 10, 1918, to A. C. Ashcraft for "ROTARY ENGINE"; and U.S. Pat. No. 1,319,932 granted Oct. 28, 1919, to S. B. Stevenson for a "ROTARY ENGINE - EXPLOSIVE TYPE." These engines and even envisagable modifications thereof within the limits of the specified disclosures in which they are to be found are truly relatively primitive and crude devices by today's standards, especially as regards meeting modern needs and requirements; and are, therefore, totally unsuited to and unacceptable for vehicular and other possible usages.

More recent endeavors to provide efficient and useful types of rotary engines for modern needs and applications have been spurred on and accelerated by the desires and necessities to conserve fuels and energization media, especially those of hydrocarbon and petroleum origin.

Notwithstanding, rotary engines of the type shown in British Patent No. 838,166 dated June 22, 1960, for improvements in or relating to "ROTARY INTERNAL COMBUSTION ENGINES" and in British Patent No. 910,417 granted Nov. 14, 1962, for "INTERNAL COMBUSTION ENGINES", have failed to overcome or really cure the deficiencies and inadequacies of earlier style rotary engines. On the other hand, some of those, such as the versions of E. T. Miller brought forth in his U.S. Pat. No. 3,852,001 issued Dec. 3, 1974, for a "FLUID TRANSLATOR", are likely adaptable for use with such pressurized fluids as steam, despite being unsuited for adaptation with combustible fuel materials, such as gasoline.

Also, rotary engines of the type taught in U.S. Pat. No. 4,200,084 issued Apr. 29, 1980, to K. Alexeev, et al., are conceivably operable with combustible fuel supplies but are seriously hindered and rendered awkward and overly complex by their requirement to have numerous moving parts, cams, seals, etc., tending to hamper manufacture and easy maintenance for good operability and, also, regardless of condition, to also reduce efficiency and balance in and of the involved unit.

Nothing heretofore, however, appears to realistically concern itself with nor teach an effective, efficient, extremely reliable and exceptionally economic apparatus assembly which is well-adapted for manufacture and admirably endowed for usage with utmost satisfaction in order to furnish a most propitious rotary piston engine drivable with a variety of fuels for power motivation of the involved apparatus in the way so crucially indigenous as are present and innately associable in and with the present invention.

SUMMARY OF THE INVENTION

The invention is directed to a rotary piston combustion engine and contemplates an assembly arrangement utilizing a rotary disc element or rotor secured to and revolvable about a main shaft for rotation between a cover member and a housing. The rotary disc element, which runs in close proximity to a conforming end or termination of the housing, carries at least two cavities or depressions equidistant (that is, 180° apart when only two cavities are utilized) on the outer circumferential peripheral surface of the rotor disc element, each of the rotor cavities representing in fact one-half, or a substantially similar proportion, of a combustion or expansion chamber which is periodically formed during rotation of the rotor disc element. Similar and analogous, equispaced matching cavities or depressions are formed and provided in and on the inner circumferential surface of the rotor-confining and rotor-accommodating portion of the housing in such a way of disposition that, when only two cavities for chamber formation are on the rotor, there is a combustion (or other expanding gas or vapor-containing) chamber formed at each 180° of revolution of the rotor disc element. The outer circumferential surface of the rotor disc element has a diameter selected to be less than the inside diameter of the inner circumferential surface of the housing. The main shaft is located at the axial center of the inner circumferential surface of the housing, and the rotor disc element is attached to the main shaft off center so that the rotor disc element rotates eccentrically. The eccentricity of rotation of the rotor disc element results in successive formation of the aforesaid combustion chambers. The formed combustion chamber is fed a compressed, combustible, vaporized fuel mixture by a smaller, impelling end of one of two double-ended or double-headed, reciprocating, positive displacement pistons incorporated functionally in the engine assembly. Each piston is reciprocally driven by a swash plate impeller which is also secured to and rotatable with the main shaft in the assembly. The motivation of the pistons by the swash plate impeller alternatively feed and charge each forming combustion chamber as it is being formed upon commencement of alignment of the rotor and housing cavities during rotation of the rotor disc element. Ignition, when following an Otto cycle mode of operation (Diesel cycle being another preferred mode of operation), then occurs so as to effectively and functionally drive what amounts to, and is the equivalent of, a rotary piston in the form of the eccentrically located rotor disc element, which is the only movable part in the assembly positively contacted and actuated by the involved expanding and machine-energizing gas.

For a significant portion of its passage, the rotor disc element is subjected to explosive driving force. Upon dissipation of that propulsive actuation, an alignment is made, as a result of rotor positioning of the formed combustion cavity, with a waste gas discharge port so as to then complete a cyclic action for the given combustion chamber after its formation in the course of rotor rotation within the engine. Rotary impedance valves, fuel mixture and other pressurized motivating fluid media are provided, usually by appropriate machining, into an impeller barrel element within the assembly to facilitate and allow intake, transfer and check valving functions. At least one roller seal is provided between the inner circumferential surface of the housing and the outer circumferential surface of the rotor disc element to confine the aforesaid expanding gas.

Thus, this invention is an improved rotary piston engine capable of being fueled and operated by an internal combustion mode. The invention thus pertains to a novel rotary piston engine construction and operational technology which is very efficient, is relatively simple and straightforward to make and run, is comparatively inexpensive to fabricate in that it has low maintenance costs and easy maintenance requirements during operation, is extraordinarily rugged and durable, is uncommonly lightweight in that it features a unit power output per unit weight rating comparable with other motive power engines, is notably adaptable for multitudinous utilizations, and is technically advanced. All of these general characteristics of the present invention (including the methods and procedures involved in the various possible embodiments of same) are amongst the principal aims and objectives hereof.

Accordingly, it is an object of the present invention to provide a new and improved rotary engine unit especially well suited to be made and operated as an internal combustion apparatus.

It is a further object of the present invention to provide a rotary piston engine drivable as an internal combustion engine, and is in any event highly efficient in its use and consumption of ignitable fuel or other energizing media.

It is still a further object of the present invention to provide a rotary internal combustion engine which owes much of its simplicity to the fact that it is easily fabricatable in that it has few major and essential moving parts in its construction.

It is still another object of the present invention to provide a rotary internal combustion engine capable of minimizing impact loads and vibration during operation and which allows and provides motive power output in a relatively smooth, continuous and stable manner.

It is yet a further object of the present invention to provide a rotary internal combustion engine which is effectively separated into two heat zones for ease of cooling by virtue of having separate and distinct intake and compression functions associated with combustion and exhaust functions so as to readily allow combustion and exhaust to be processed in and through the rotor housing area of the engine assembly and subsequently exhausted through open ports in the block of the engine assembly.

It is an additional object of the present invention to provide a rotary engine of the internal combustion variety, which utilizes differentially sized, double-ended, positive displacement pistons for energizing media (such as a combustible fuel/air mixture) intake, transfer and necessary compression preparation functions external from the gas expansion chamber of the engine.

It is yet an additional object of the present invention to provide a rotary internal combustion engine which has a swash plate impeller drive to cause reciprocal motion in double-ended piston inclusions in the assembly in order to effectuate and perform energizing media (such as a combustible fuel/air mixture) intake, transfer and necessary compression effectuation and functions in and for the engine.

It is still a further object of the present invention to provide a rotary internal combustion engine having the above-described double-ended piston and swash plate impeller disc drive components and which utilizes, as one preferred means for this purpose, split ball tracking bearings in association with the swash plate impeller disc drive to facilitate smooth and sure transfer of the swash plate impeller disc drive force for operation and movement, during running of the engine, of the reciprocally-performing double-ended piston components.

And, it is yet a further object of the present invention to provide a rotary internal combustion engine of the above-indicated type which, having the above-mentioned distinctive and separated heat or temperature zones therein, allows for greater choices and diversities in the employed materials of construction and fabricating techniques in and for engine assembly as compared with conventional internal combustion engines.

The achievement of all the above indicated objects, with additional benefits and advantages derivable as accruements and desiderations thereto, will become more apparent in the ensuing detailed description taken in conjunction with the drawing attached hereto.

DETAILED DESCRIPTION OF THE PREFERRED EMBODIMENT

Figure 1:
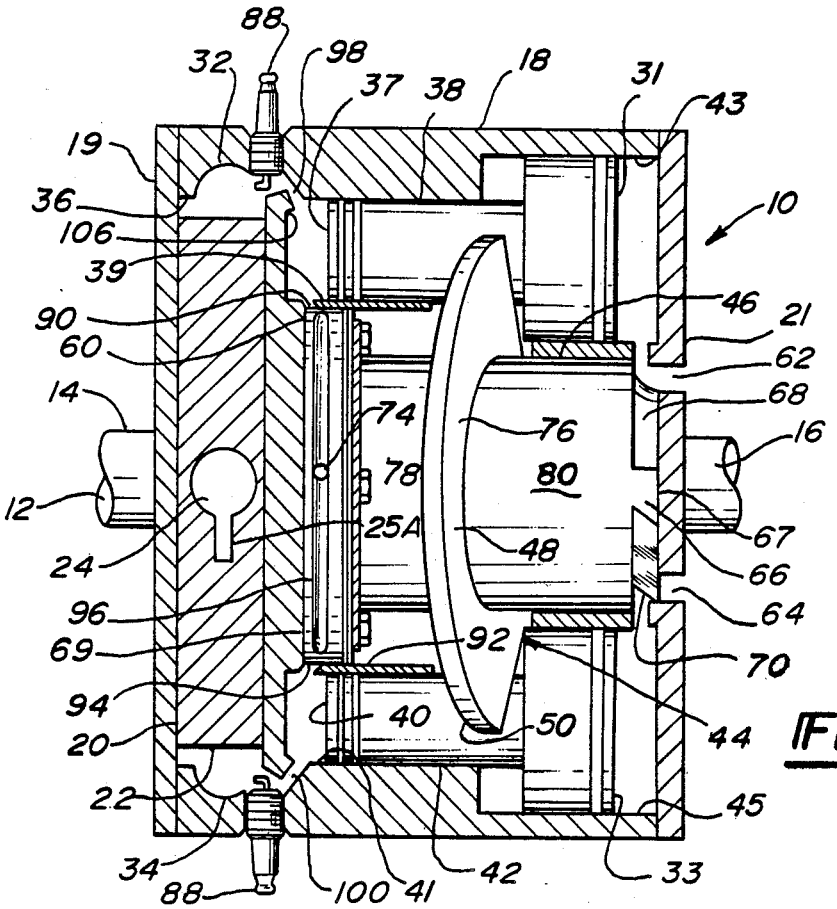
FIG. 1 is a broken-away plan view, partly in section, of the rotary internal combustion engine according to the present invention in which the rotor element cavities are situated at a mid-point between the housing cavities and the pistons are at their "mid-stroke" positionings.

Looking with particularity to the several views of the drawing, an applied construction of the invention is now explained which, for convenience, is a described and illustrated construction of a rotary piston internal combustion gasoline engine.

As has been indicated, however, engines adapted to the internal combustion mode of powering of operation can also be designed within the scope of the invention utilizing other vaporizable liquid hydrocarbon or petroleum-based fuel stocks as well as other combustible fuel materials of known constitution and character. These include the so-called diesel fuels, as well as propane and the like; that is, normally-gaseous hydrocarbon combustibles. Other cycle processes are also contemplated including the Diesel cycle.

Now, then, referring first to FIG. 1 of the drawing, there is shown an engine assembly 10 according to the present invention, aspects of the major and essential components of the apparatus being arranged in functional, cooperative, combined style for operation. The same is applied to the portrayals of FIGS. 2 and 8.

Figure 8:
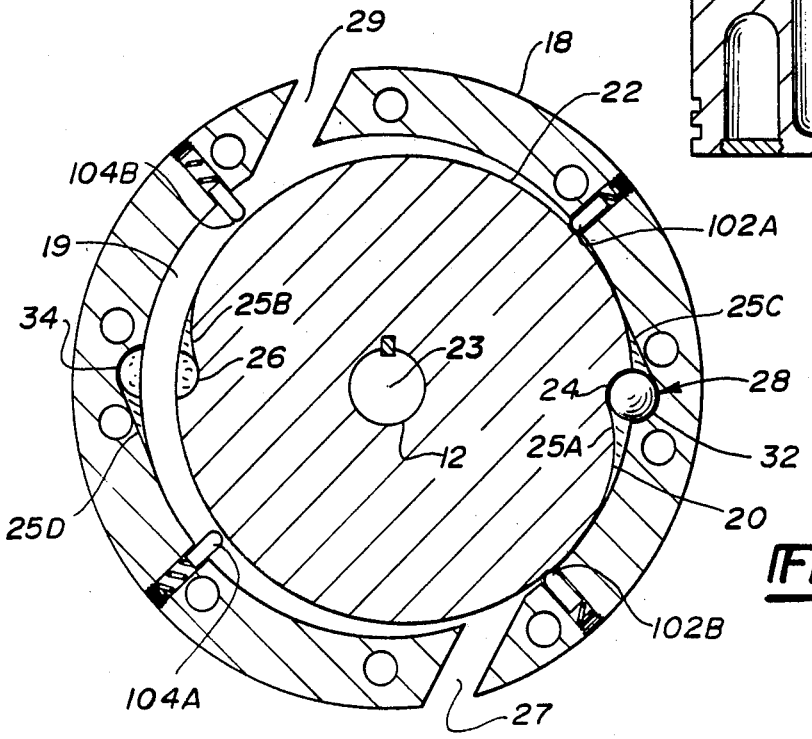
FIG. 8 is a front view, taken in section, of the engine according to the present invention, portraying the rotor element and showing therewith combustion chamber and exhaust port arrangements made in the housing.

In the assembly there is provided and appropriately mounted on a bearing (not shown), a main shaft 12 having a forward end 14 and a rearward end 16. The main shaft 12 is rotatably installed, via the bearing, in a housing 18, the housing including a forward cover plate 19 and a rearward cover plate 21, each of the cover plates supporting the aforesaid bearings. In each of FIGS. 1, 2 and 9, the forward end of the main shaft 12 extends to the left-hand side of each illustration. About the forward end 14 of the main shaft 12 is firmly affixed thereto and rotatable therewith a circularly-shaped rotor disc element 20 having a circumferential, peripheral surface 22; this surface being of cylindrical nature and generated as to be in eccentric relation with the axis of rotation of the main shaft 12 as shown in FIG. 8. The eccentric relation is achieved by connecting the rotor disc element to the main shaft at an off center location 23 of the rotor disc element, as shown in FIG. 8.

The rotor disc element 20 is preferably fabricated so as to contain on its outer circumferential surface 22 two rotor cavities 24 and 26 occurring as relatively deep indentations or depressions extending below the circumferential surface 22 of the rotor disc element 20 and of appropriate volumetric size and shape so as to suitably provide at least a substantial portion, preferably exactly half, of the desired capacity of the combustion chamber it is intended to in part form periodically during rotation of the rotor disc element 20 in its rotational travel while the engine is being run. As brought out in FIG. 2, one rotor cavity 24 is involved in forming a combustion chamber 28. This occurs when the rotor cavity 24 aligns with a housing cavity 32. The other rotor cavity 26, equispaced 180° from the rotor cavity 24, provides balance in the rotor disc element 20. A second combustion chamber is formed when the rotor cavity 24 has rotated to align with another housing cavity 34.

The engine outer casing or housing 18 is built to extend forward and backward along the main shaft 12 and, at its forward end, is internally shaped cylindrically (at least within its forward internal portion) so as to have an inner circumferential surface 36. The equispaced housing cavities 32 and 34 are formed as indentations or depressions which back up into the inner circumferential surface 36 of the housing 18 so as to match those on the rotor element 20. Preferably, as is the case with the rotor cavity 24, the housing cavities 32 and 34 form exactly half of the periodically formed combustion chamber volume.

It will be seen from FIG. 8 that the rotor cavities 24 and 26 and the housing cavities 32 and 34 each respectively have a lead cut 25A, 25B, 25C and 25D. Further, exhaust openings 27 and 29 are provided in the housing 18. The lead cuts and the exhaust openings facilitate aspiration of the combustion chambers, as will be described hereinbelow.

The rotor disc element 20 is mounted on the main shaft 12 off center. That is, the center of the rotor disc element is displaced in the direction away from the rotor cavity 24 that is involved in combustion functions. The outer circumferential surface 22 of the rotor disc element has a diameter less than the diameter of the inner circumferential surface 36 of the housing. The offset location of the rotor disc element on the main shaft cooperates with the aforesaid difference in diameters so that the outer circumferential surface 22 surrounding the rotor cavity 24 is adjacent the inner circumferential surface 36 of the housing. The outer circumferential surface 22 surrounding the rotor cavity 26 is separated from the inner circumferential surface 36. The offset relationship of the rotor disc element in relation to the housing and the main shaft affords production of a net unbalanced force during combustion, as will be explained hereinbelow.

When the rotor cavity 24 is rotated into an aligned position with the matching housing cavity 32 in the housing 18 so as to be in conformed opposition therewith, the first combustion chamber 28 is formed. Similarly, when the rotor cavity 24 is rotated into alignment with matching housing cavity 34, a second combustion chamber is formed identical to the first combustion chamber 28. These combustion chambers are completed when the smaller or forward end 37 and 40, respectively, of a respective one of double-ended first and second pistons 38 and 42 is reciprocated during operation of the engine to its forward-most point of travel (towards the forward end 14 of the main shaft 12 whereat the rotor disc element 20 is installed), which is its maximum stroke location.

Figure 2:
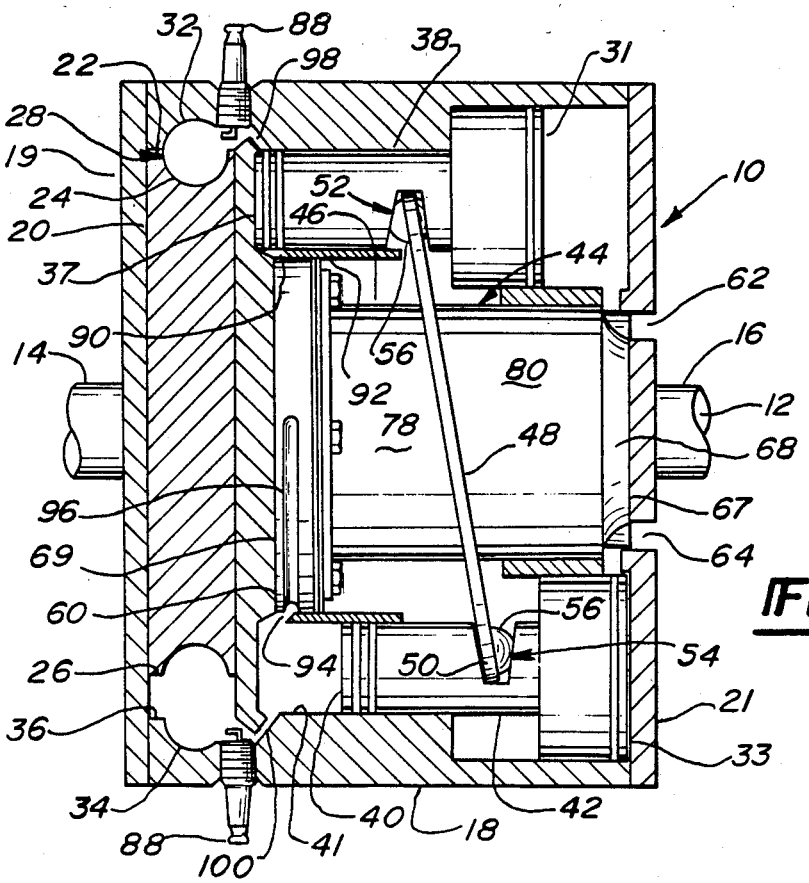
FIG. 2 is a broken-away plan view of the engine assembly of FIG. 1 and in section analogous thereto, in which the rotor element cavities are aligned with the housing cavities, and the pistons are at extremes of their respective strokes.
Figure 9:
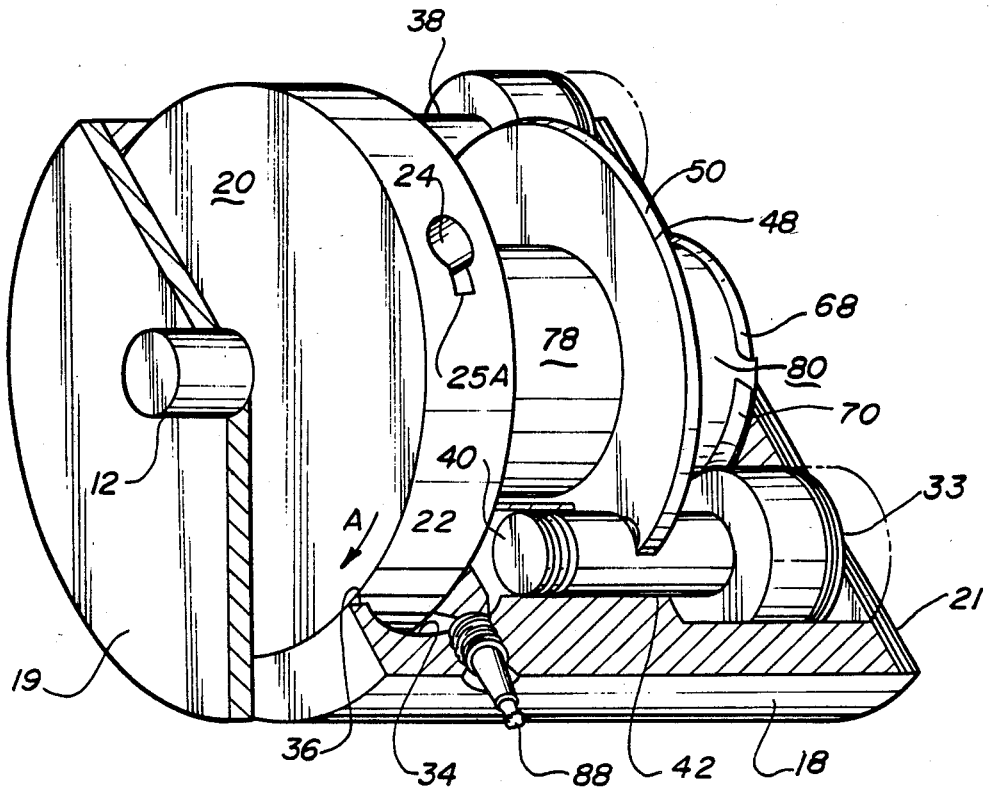
FIG. 9 is a perspective view, partly in section, of the engine according to the present invention, with the engine assembly housing cut or broken away, the rotor element being situated as in FIG. 1.

As can be seen from FIGS. 1, 2 and 9, the pair of reciprocable pistons 38 and 42 are included within the engine assembly 10. The purpose of these pistons is to deliver combustible gas to the periodically formed combustion chambers. Each piston includes the forward, smaller end 37 and 40, respectively, and a larger rearward end 31 and 33, respectively. The forward end of the pistons reciprocates in a cylinder 39 and 41, respectively, which is sized for a respective sealing engagement therewith; the rearward end of the pistons reciprocates in a cylinder 43 and 45, respectively, which is sized for respective sealing engagement therewith. The pistons serve as combustible gas delivery agents in a manner discussed hereinbelow.

In this connection, it is noteworthy and of distinctive character insofar as concerns rotary piston engines to have as is done in the preferred embodiment of the present invention, the pistons of the machine moving and working their particular function in a longitudinally oriented stroke following a fixed in station path in the assembly 10 that is concentric with the centerline of rotation of the drive-transmitting main shaft 12 without, in fact, entering into the formed combustion chambers or, for that matter, lending a surface upon which the expanding gas operates. This is very different from the case of conventional, piston-driven internal combustion or other pressurized fluid engines wherein the functional piston elements are directly exposed to expansion gases in the cylinder enclosures during compression and expansion strokings in the operating cycle thereof.

Also firmly fixed in attachment to and about the main shaft 12 rearwardly along its length away from the rotor element 20 is an impeller device 44 (for ultimately reciprocatively-motivating the first and second pistons 38 and 42) in the form of an impeller barrel 46 upon which is securely mounted (so as to move circularly with movement of the main shaft 12 and surrounding impeller barrel 46) a swash plate impeller blade 48. Reciprocation of the pistons is achieved by constant contact between the swash plate impeller blade 48 at its outer peripheral rim 50 with connecting members 52 and 54, respectively, for accommodating swiveling of the rim 50 during rotation located at an intermediate rod-like portion of each of the first and second pistons 38 and 42. While equivalents are available, a preferred connecting member allowing the outer, reciprocally-moving rim of the swash plate impeller blade 48 to motivate the pistons reciprocally is a split ball tracking bearing 56 shown in FIG. 7 but also seen in FIG. 2 mounted to and contained in a suitable socket formation along the length (usually cylindrical) between the ends or heads of each of the first and second double-ended pistons 38 and 42. As can be understood from FIG. 7, an adjustment and clamping screw 58 secures, maintains and positions good joinder for motivating cooperation with and between the swash plate impeller blade 48 and each of the first and second pistons 38 and 42. The clamping screw is threaded to be received in a threaded aperture 59 in the pistons and is threaded thereinto so as to provide precise alignment of the ball tracking bearings with the swash plate impeller blade rim. The structure shown provides excellent and precise working contact and reliable engagement during operation between the swash plate impeller blade 48 and each of the first and second pistons 38 and 42.

Figure 3:
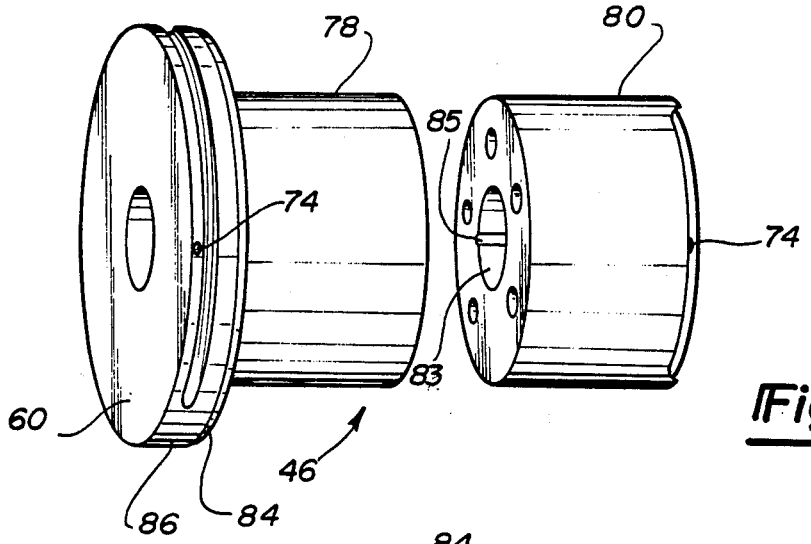
FIG. 3 is a broken-apart view taken in elevation of the impeller barrel, the impeller barrel being oriented as in FIG. 1.
Figure 5:
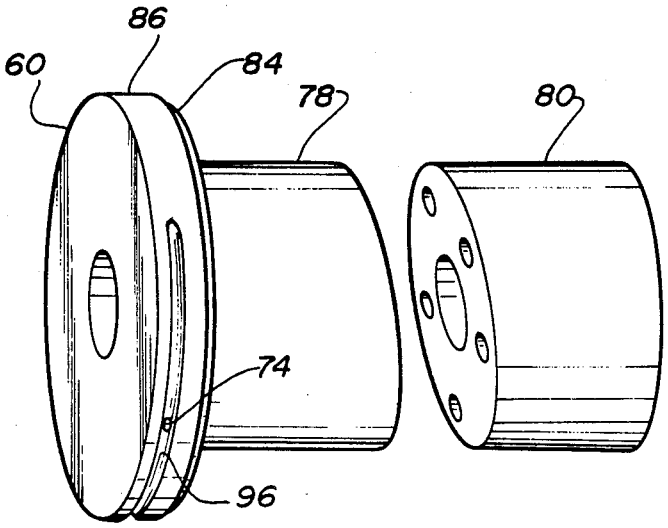
FIG. 5 is a broken-apart view in elevation of the impeller barrel, the impeller barrel being oriented as in FIG. 2.
Figure 6:
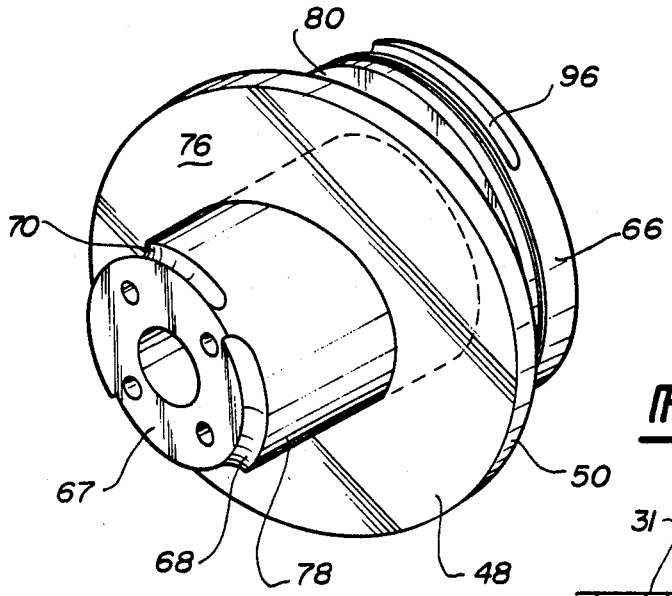
FIG. 6 is a perspective view of the impeller device which is otherwise illustrated in FIGS. 1 through 5.

The impeller barrel 46 is structured to additionally function as a multiple rotary valve arrangement for effective and efficient running and operation of the engine assembly 10. This is demonstrated by FIGS. 1, 2 and 6 as well as by FIG. 9. There are provided at appropriate locations in the rearward engine housing cover 21 a pair of primary intake port openings 62 and 64. There is located in the terminal peripheral circumference 66 of the impeller barrel 46 at its rear end 67 a first quarter-relief 68 therein. As shown in FIG. 6, this indentation 68 extends along the terminal circumference 66 and provides selective communication between the ports 62 and 64 and the cylinders 43 and 45. A second quarter-milled-relief 70, as shown in FIG. 1 as well as in FIG. 6, extends along the terminal peripheral circumference 66 and forms a slot for communicating fluid selectively between the cylinders 43 and 45 and a passageway 74 which is described hereinbelow. The relief 70 provides an intermediate passageway (or introductory, as it were, routing path) for vapor or gas flow from the inlet or intake ports 62 and 64 feeding into the intake valving in and for its transfer from the rear end 67 of the impeller barrel to its forward end 69 towards the rotor element 20. The impeller barrel circumference 66 at the first and second quarter-milled-relief renders, at needed and appropriate times in the cycle, a temporary blockage of and stoppage for all flow as that is momentarily unwanted so as to separate the valving functions. The passage of combustible vapor from its rearward intake end for delivery ultimately to the two combustion chambers is through the drilled or otherwise bored or tunneled passageways 74 running through the interior of the impeller barrel 46 and leading into and out of the circumference of the impeller barrel, as is shown for one of them in FIG. 4 and also indicated in FIGS. 3 and 5 of the drawing.

As appears in FIG. 6 (as well as in FIGS. 1, 2, 4 and 9), the swash plate impeller blade 48 for reciprocatingly motivating and stroking the first and second pistons 38 and 42, respectively, is generally circular at its outer peripheral rim 50. This, of course, can be varied to best suit and accommodate particular engine assembly arrangements that are implemented.

Further, the swash plate impeller blade 48 is set so as to be canted from perpendicular alignment upon the main shaft 12 so as to regulate and determine the length of travel of piston stroke according to the degree of cant. Again, according to particular given engine designs and specification characteristics, the degree of cant imparted to the swash plate impeller blade 48 can be readily varied to best meet the needs and exigencies of given operating requirements for any particular installation. A typical and frequent satisfactory impeller blade degree of cant for usual installations of the presently contemplated rotary engine apparatus is at or about 10.4° from the normal plane emanating from the impeller barrel center as defined along the main shaft 12 with respect to the flat surface 76 of the swash plate impeller blade 48. The swash plate impeller blade is thereby tilted to assume an alternating yawing disposition during rotation of the impeller barrel.

As shown in the illustrations, the impeller barrel 46 is composed of two parts 78 and 80 which mate with the swash plate impeller blade 48. The impeller device 44 is then held together by four counter-sunk bolts 82. A center aperture 83 of the impeller barrel is keyed or splined, as shown at 86 to the main shaft 12 for affixing the impeller device 44 on the main shaft.

Figure 4:
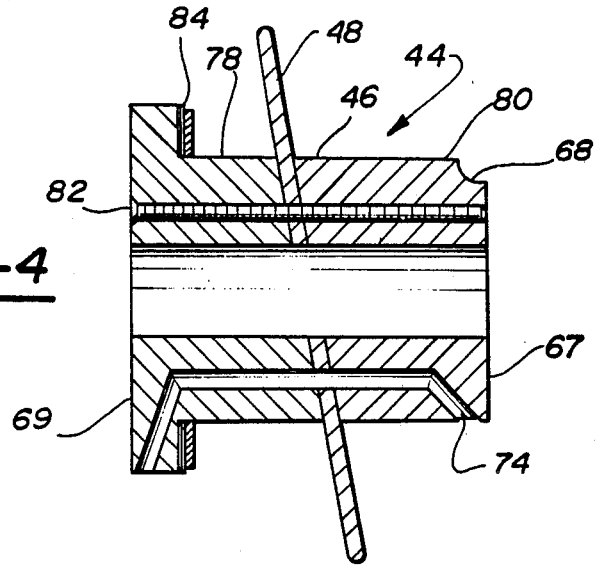
FIG. 4 is a side view, taken in section, of the impeller device, showing the passageway communicating between ends thereof.

FIG. 4 (as well as FIGS. 3 and 5) show a double seal 84 adjacent the periphery 86 of an annular shoulder 60 located at the forward end 69 of the impeller barrel 46. The double seal serves to isolate the annular shoulder from the interior of the main block of the engine assembly by abutting an annular wall 92 of the housing.

Figure 7:
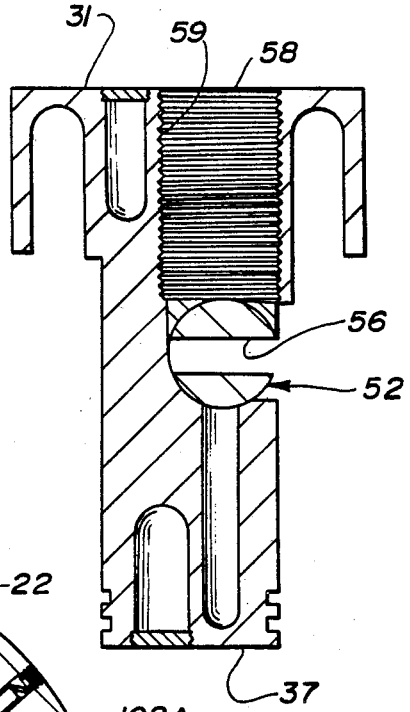
FIG. 7 is an enlarged, cross-sectional side view taken along the plane intersecting the centerline or axis of either piston.

As has been discussed and brought forth, satisfactory piston structure for present purposes is detailed in FIG. 7. The important function of the piston units in the engine assembly 10 is their role in effectuating synchronization of the feed of energizing media into the forming combustion chambers. This is accomplished by having the piston feeding function timed with respect to the rotation of the rotor disc element 20 so that fluidic communication is present as the particular combustion chamber is forming, but closed at all other times. In other words, there is no piston-assisted fuel or other energizing media fed to any formed chamber during combustion and exhaust processes of rotor element rotation. In one sense, in fact, each piston in its manner of function and operation behaves somewhat like a particular variety of a two-stage compressor device. This comes from its first compression of the energizing media (such as a combustible fuel medium) being fed after its initial aspiration into the assembly by means of the vacuum-effect of the rearward end 31 and 33, respectively, of the pistons 38 and 42, when moving toward the rotor disc element 20 when the first quarter-milled relief 68 allows fluidic communication with a respective one of the intake ports 62 and 64. Then when moving away from the rotor disc element 20 and the aforesaid communication is cut-off, the second quarter milled relief 70 allows gas to be compressed through the passageway 74 into a particular cylinder 39 or 41 selectively through a rotary valve slot 96 in the annular shoulder and a respective housing opening 90 and 94. Subsequent reverse movement of the respective forward piston end 37 or 40 causes gas to be compressively delivered to the respective forming combustion chamber through a respective housing port 98 or 100, when the rotary valve slot 96 has rotated so as to prevent gas movement through the passageway 74. When the combustion chamber is fully formed and gas has been delivered thereto, the spark plug 88 is fired resulting in a torque being applied to the rotor disc element 20. To retain the compressive forces of the combusting and combusted fuel, a pair of roller valves 102A, 102B and 104A, 104B, are respectively provided for each housing cavity, located between the housing cavity and its respective exhaust opening 27 or 29. Each roller valve is biased to follow the outer circumferential surface 22 of the rotor disc element.

From the foregoing, it should be clear that the rotary internal combustion engine according to the present invention derives all of its motive power from combustion in the periodically formed combustion chambers with the expansion of the combusted fuel being directed against the rotor disc element 20 to produce rotary movement thereof. The pistons 38 and 42 are not exposed to the expanding gases of the combusted fuel, and, accordingly, the pistons do not participate in producing rotary movement; the pistons serve only as fuel mixture intake devices to the forming combustion chambers.

Operation will now be detailed with respect to the combustion chamber 28. The main shaft 12 is rotated. Rotation of the main shaft causes the impeller barrel 46 to rotate as well as its attached swash plate impeller blade 48. The swash plate impeller blade causes the double-ended piston 38 to reciprocate so that rearward end 31 is caused to move toward the rotor disc element 20. A vacuum is created thereby in the cylinder 43 while at the same time the first quarter-milled relief 68 permits fluidic communication between the intake port 62 and the cylinder 43. Continued rotation of the main shaft results in the double-ended piston 38 reaching its furthest stroke location toward the rotor disc element. At this point, combustible gases will have been sucked from the intake port 62 and are now contained in the cylinder 43. Additional rotation of the main shaft results in the double-ended piston moving away from the rotor disc element. Accordingly, the gas now in the cylinder 43 is pushed thereout by entry of the piston rearward end 31 into the cylinder. At this same time, the aforesaid fluidic communication between the intake port 62 and the cylinder 43 is terminated by the first quarter-milled relief having rotated from the intake port 62. Further, at this same time, the second quarter-milled relief 70 has rotated into position such as to permit fluidic communication between the cylinder 43 and passageway 74. Still further, the rotary valve slot 96 has rotated to permit fluidic communication between the passageway 74 and the housing opening 90. Accordingly, gas is transferred from the cylinder 43 to the cylinder 39 through the passageway 74. Eventually, the piston 38 reaches a location of maximum stroke in which it is furthest from the rotor disc element. At this point, fluidic communication between the cylinders 43 and 39 is cut-off because the rotary valve slot 96 has rotated to a position away from the housing opening 90. Continued rotation of the main shaft results in the piston 38 moving again toward the rotor disc element. Accordingly, gas in the cylinder 39 is now forced through the housing port 98 into the forming combustion chamber 28 through the lead cuts 25A and 25C. When the piston 38 has reached its end of stroke closest to the rotor disc element, and the forward end 37 thereof is masked by an annular lip 106, the spark plug 88 is fired, triggering combustion of the gas in the combustion chamber 28.

The rotor disc element is connected to the main shaft eccentrically. This eccentricity creates an imbalance, which forces the rotor disc element to rotate in a direction of increasing separation from the housing inner circumferential surface 36. The aforesaid rotational direction is indicated in FIG. 9 by arrow A. Combustion gases are confined to the combustion chamber 28 as well as the space between the circumferential surface 22 of the rotor disc element 20 and the inner circumferential surface 36 of the housing 18 between the roller valves 102A and 102B. When the rotor disc element has rotated to a location in which the lead cut 25A begins to move beyond the roller valve 102B, combusted gas then vents to the exhaust opening 27. At this point, the cycle is ready to repeat with respect to the second formed combustion chamber.

Complementary to that discussed hereinabove, it is worthwhile to further notice as within the ken of the artisan that along with the immediate foregoing and other involved parts and pieces of prospective apparatus, assemblies, and operating techniques pursuant to the invention, the rotary piston engine includes additional items as: lubricants, sealings, packings, sealing lubrications, bearings, journals and other mountings for rotatable elements (such as shafts, generally-cylindrical constructions, etc.), fasteners and other joining provisions including weldings, solderings, brazings and the like or equivalent securements, shimming and motion-stopping supplements, such as flangings and the like, piston ring and wall provisions, aperture, opening and passageway or channel constructions, threadings and implementations, means for mounting driven parts about arbors, shafts and so forth including locking keys and keyways, screw gearings, splines, shrink fits, headings and swagings, etc., moving elements and parts associations, mountings, and so forth that in general are common to and ordinarily practiced in the field of engine mechanics.

While the illustrated embodiment discloses an engine made with a single drive or main shaft, it is to be understood that several such engines may be mounted in tandem upon the same main shaft so as to effect an advantageous multiplication of output power and capability with a unitary engine construction.

Power take off means and transmission units are not discussed nor positively called for in the foregoing. Neither are clutches nor clutching appliances or the like when it is wanted to effectively idle power generation or application without stopping the engine. Neither is carburetion, timing devices for ignition, nor exhaust handling systems such as mufflers. For that matter, engine stopping and starting provisions are likewise not brought in as all of these are within the skill of those versed in the relevant art.

As is deducible from the foregoing revelations, engines in accordance with the present invention may be provided so as to have additional (i.e., more than a pair of) cylinders incorporated therein and so disposed in the assembly as to be capable of charging additional combustion (or other expansion) chambers about the same rotor element in the housing of the engine. Further, it is likewise readily comprehensible that additional piston means may be arrayed around the same main shaft and on opposite sides of the same rotor disc element.

It is to be recognized and comprehended that many modifications can be readily made to the present invention without substantial or materially-meaningful departation from its apparent and intended spirit and scope as to embodiments and practices thereof and in keeping therewith, which is all pursuant to and in accordance with that which is set forth and delineated in the hereto-appended claims.

What is claimed is:

1. A rotary piston internal combustion engine driven by a combustible gas, comprising:

a housing having a forward end, a rearward end, and an inner cylindrical surface located at said forward end;

a main shaft bearingly attached to said housing, said main shaft having an axis of rotation concentric with said inner cylindrical surface;

a rotor disc element eccentrically attached to said main shaft, said rotor disc element having its center off set from said axis of rotation and having a peripheral surface, a predetermined portion of said peripheral surface sealingly engaging said inner cylindrical surface of said housing;

at least one first cavity formed in said predetermined portion of said peripheral surface of said rotor disc element, said at least one first cavity forming a first portion of a combustion chamber;

at least one second cavity formed in said inner cylindrical surface of said housing, said at least one second cavity forming a second portion of said combustion chamber, said at least one first cavity and said at least one second cavity periodically aligning with each other as said rotor disc element rotates to form said combustion chamber in at least one predetermined location during each complete rotation of said rotor disc element;

means for transferring said combustible gas upon formation of said combustion chamber to generate a force to said rotor disc element;

means for venting said combustible gas after said combustible gas has undergone combustion; said means for venting being located in said housing a predetermined distance from said at least one second cavity; and means for synchronizing said means for transferring, combusting, and venting so that said rotor disc element will rotate.

2. The rotary piston internal combustion engine of claim 1, wherein said means for transferring said combustible gas comprises:

at least one double-ended piston disposed in said housing for reciprocation along an axis substantially parallel with said axis of rotation; and means connected to said main shaft for reciprocating said at least one double-ended piston in response to rotation of said rotor disc element, said reciprocation of said at least one double-ended piston transferring said combustible gas into said combustion chamber during its formation.

3. The rotary piston internal combustion engine of claim 2, wherein said means for reciprocating said at least one double-ended piston comprises:

an impeller barrel connected to said main shaft so as to rotate therewith within said housing, said impeller barrel having a first end and a second end;

a swash plate impeller blade connected to said impeller barrel and canted in relation thereto, said swash plate impeller blade having a peripheral rim; and split ball bearing means provided in said at least one double-ended piston for receiving said peripheral rim of said swash plate impeller blade, rotation of said swash plate impeller blade with the rotation of said main shaft reciprocating said at least one double-ended piston.

4. The rotary piston internal combustion engine of claim 3, wherein said at least one double-ended piston has a rearward piston and a forward piston, said means for transferring said combustible gas further comprising:

at least one port provided in said rearward end of said housing;

a first relief provided in said first end of said impeller barrel for selectively allowing fluidic communication between said at least one port in said rearward end of said housing and said rearward piston;

an annular shoulder provided at said second end of said impeller barrel;

a rotary valve slot provided in said annular shoulder;

a passageway provided within said impeller barrel between said first end of said impeller barrel and said rotary valve slot;

a housing opening provided between said forward piston and said second end of said impeller barrel so that said rotary valve slot may selectively allow fluidic communication between said passageway and said forward piston;

a second relief provided in said first end of said impeller barrel for selectively allowing fluidic communication between said rearward piston and said passageway; and a housing port connecting said at least one second cavity and said forward piston.

5. The rotary piston internal combustion engine of claim 4, wherein said means for combusting said combustible gas includes roller valve means for sealing said combusting of combustible gas, said roller valve means being located between said at least one second cavity and said means for venting said combustible gas.

6. A rotary piston internal combustion engine of claim 5, wherein each of said at least one first cavity and said at least one second cavity includes a lead cut to facilitate said means for transferring said combustible gas as said combustion chambers form.

7. The rotary piston internal combustion engine of claim 6, wherein said forward piston has a first diameter, further wherein said rearward piston has a second diameter, said first diameter being less than said second diameter.

8. The rotary piston internal combustion engine of claim 7, wherein said means for combusting said combustible gas includes selective ignition means connected with said housing.

9. A rotary piston internal combustion engine driven by a combustible gas, comprising:

a housing having a forward end, a rearward end, and an inner cylindrical surface located at said forward end, said housing further having a first intake port and a second intake port at said rearward end thereof, said first and second intake ports being connected to a source of said combustible gas;

a main shaft bearingly attached to said housing, said main shaft having a forward and a rearward end;

a rotor disc element fixedly attached to said forward end of said main shaft, said rotor disc element being attached to said main shaft off center of said rotor disc element, said rotor disc element having a peripheral surface, said rotor disc element being located in said forward end of said housing;

a first rotor cavity and a second rotor cavity each formed substantially 180° apart in said peripheral surface of said rotor disc element such that said peripheral surface adjacent said first rotor cavity is in sealing engagement with said inner cylindrical surface of said housing;

a first housing cavity and a second housing cavity each formed substantially 180° apart in said inner cylindrical surface of said housing, said first rotor cavity mutually aligning successively with said first housing cavity and said second housing cavity as said rotor disc element rotates to form successively two combustion chambers substantially 180° apart at predetermined locations in said rotary internal combustion engine during each complete rotation of said rotor disc element;

means for transferring said combustible gas to each of said two combustion chambers during formation of each of said two combustion chambers;

means for combusting said combustible gas upon formation of each of said two combustion chambers, said combusting of said combustible gas imparting rotary motion directly upon said rotor disc element, said combustion occurring external to said means for transferring said combustible gas;

means for venting said combustible gas after said combustible gas has undergone combustion, said means for venting comprising a first venting means and a second venting means, said first venting means being located in said housing a predetermined distance from said first housing cavity, said second venting means being located in said housing a predetermined distance from said second housing cavity; and means for synchronizing said means for transferring, combusting, and venting so that said rotor disc element will rotate.

10. The rotary piston internal combustion engine of claim 9, wherein said means for transferring said combustible gas comprises:

a first double-ended piston means disposed in said housing, said first double-ended piston means having a reciprocable motion along an axis substantially parallel with said main shaft;

a second double-ended piston means disposed in said housing, said second double-ended piston means having a reciprocable motion along an axis substantially parallel with said main shaft; and means connected to said main shaft for causing said reciprocable motion of said first and second double-ended piston means in response to rotation of said rotor disc element, said reciprocable motion of said first double-ended piston means transferring said combustible gas into a respective one of said two combustion chambers upon their formation.

11. The rotary piston internal combustion engine of claim 10, wherein said means for causing said reciprocable motion of said first and second double-ended piston means comprises:

an impeller barrel connected to said main shaft so as to rotate therewith within said housing, said impeller barrel having a first end and a second end;

a swash plate impeller blade connected fixedly with said impeller barrel and canted in relation to said impeller barrel, said swash plate impeller blade having a peripheral rim; and split ball bearing means in each of said first and second double-ended pistons for receiving said peripheral rim of said swash plate impeller blade, rotation of said main shaft resulting in said swash pate impeller blade imparting said reciprocable motion upon said first and second double-ended piston means.

12. The rotary piston internal combustion engine of claim 11, wherein each of said first and second double-ended piston means has a rearward piston means and a forward piston means, said means for transferring said combustible gas further comprising:

a first intake port in said rearward end of said housing;

a second intake port in said rearward end of said housing;

a first milled relief means in said first end of said impeller barrel for selectively allowing fluidic communication between said first intake port and said rearward piston means of said first double-ended piston means and for selectively allowing fluidic communication between said second intake port and said rearward piston means of said second double-ended piston means;

an annular shoulder at said second end of said impeller barrel;

a rotary valve slot in said annular shoulder;

at least one passageway within said impeller barrel between said first end of said impeller barrel and said rotary valve slot;

a first housing opening between said forward piston means of said first double-ended piston means and said second end of said impeller barrel so that said rotary valve slot selectively allows fluidic communication between said at least one passageway and said forward piston means of said first double-ended piston means;

a second housing opening between said forward piston means of said second double-ended piston means and said second end of said impeller barrel so that said rotary valve slot selectively allows fluidic communication between said at least one passageway and said forward piston means of said second double-ended piston means;

a second milled relief means in said first end of said impeller barrel for selectively allowing fluidic communication between said rearward piston means of said first double-ended piston means and said at least one passageway and for selectively allowing fluidic communication between said rearward piston means of said second double-ended piston means and said at least one passageway;

a first housing port between said first housing cavity and said forward piston means of said first double-ended piston means; and a second housing port between said second housing cavity and said forward piston means of said second double-ended piston means.

13. The rotary piston internal combustion engine of claim 12, wherein said means for combusting said combustible gas includes a first roller valve means and a second roller valve means for sealing said combusting of said combustible gas, said first roller valve means comprising a first roller valve and a second roller valve, said first roller valve being located between said first housing cavity and said first venting means, said second roller valve being located between said first housing cavity and said second venting means, said second roller means comprising a third roller valve and a fourth roller valve, said third roller valve being located between said second housing cavity and said second venting means, said fourth roller valve being located between said second housing cavity and said first venting means.

14. The rotary piston internal combustion engine of claim 13, wherein said first rotor cavity and said first housing cavity each include a lead cut for facilitating said means for transferring said combustible gas as said first combustion chamber is forming; further wherein said second housing cavity includes a lead cut for facilitating, in combination with said lead cut of said first rotor cavity, said means for transferring said combustible gas as said second combustion chamber is forming.

15. The rotary piston internal combustion engine of claim 14, wherein each said forward piston means of said first and second double-ended piston means includes a piston having a first diameter, further wherein each said rearward piston means of said first and second double-ended piston means includes a piston having a second diameter, said first diameter being less than said second diameter.

16. The rotary piston internal combustion engine of claim 15, wherein said means for combusting said combustible gas includes selective ignition means located adjacent each of said first and second housing cavities.

17. A rotary piston internal combustion engine driven by a combustible gas, comprising:

a housing having a forward end, a rearward end, and an inner cylinder surface located at said forward end thereof, said housing further having a first intake port and a second intake port at said rearward end thereof, said first and second intake ports being connected to a source of said combustible gas;

a main shaft rotatably attached to said housing, said main shaft having a forward end and a rearward end;

a rotor disc element fixedly attached to said forward end of said main shaft, said rotor disc element being attached to said main shaft off center of said rotor disc element, said rotor disc element having a peripheral surface, said rotor disc element being located in said forward end of said housing;

a first rotor cavity and a second rotor cavity each formed substantially 180° apart in said peripheral surface of said rotor disc element such that said peripheral surface adjacent said first rotor cavity is in sealing engagement with said inner cylindrical surface of said housing;

a first housing cavity and a second housing cavity each formed substantially 180° apart in said inner cylindrical surface of said housing, said first rotor cavity mutually aligning successively with said first housing cavity and said second housing cavity as said rotor disc element rotates to form successively two combustion chambers substantially 180° apart at predetermined locations in said rotary internal combustion engine during each complete rotation of said rotor disc element;

a first cylinder and a second cylinder connected to said housing adjacent said forward end thereof, said first and second cylinders each having a cylindrical axis oriented in parallel relation with respect to said main shaft;

a third cylinder and a fourth cylinder connected to said rearward end of said housing, said third cylinder having a cylinder axis concentric with said cylindrical axis of said first cylinder, said fourth cylinder having a cylindrical axis concentric with said cylinder axis of said second cylinder, said third and fourth cylinders each having a larger cross-section than that of said first and second cylinders;

first piston means having a forward piston end sealingly reciprocable in said first cylinder and a rearward piston end sealingly reciprocable in said second cylinder;

second piston means having a forward piston end sealingly reciprocable in said third cylinder and a rearward piston end sealingly reciprocable in said fourth cylinder;

an impeller barrel fixedly attached to said main shaft, said impeller barrel having a first end and a second end, said impeller barrel having a first periphery at said first end thereof, said first periphery having a first milled relief and a second milled relief at predetermined location thereon, said first and second milled reliefs cooperating with said first and second intake ports in said housing to permit combustible gas to selectively enter said third and fourth cylinders, said impeller barrel further having an annular shoulder at said second end thereof, said annular shoulder having a second periphery, said second periphery having a rotary valve slot at a predetermined location thereon, said rotary valve slot selectively fluidically communicating with said first and second cylinders, said impeller barrel further having at least one passageway between said first and second ends thereof for selectively providing a passageway for said combustible gas from said third and fourth cylinders to said rotary valve slot;

a swash plate impeller blade fixedly attached to said impeller barrel in a tilted orientation thereto, said swash plate impeller blade having a circular periphery, said swash plate impeller blade further being interconnected with said first and second piston means for causing said first and second piston means to reciprocably move in response to said rotation of said rotor disc element, said reciprocable movement of said first and second piston means in combination with rotation of said impeller barrel causing said combustible gas to be selectively transferred from said source of combustible gas to each of said two combustion chambers upon successive formation thereof;

ignition means adjacent said first and second housing cavities, said ignition means selectively igniting said combustible gas when said combustible gas is transferred to each of said two combustion chambers upon successive formation thereof, said combusting of said combustible gas imparting rotary motion to said rotor disc element, said combustion occurring external to said first and second piston means;

a pair of exhaust ports located in predetermined locations in said housing for venting said combustible gas after said combustible gas has undergone combustion in each of said two combustion chambers;

roller valve means located at predetermined locations in said rotary piston internal combustion engine for sealing said combusting of said combustible gas; and split ball bearing means respectively received in each of said first and second piston means to interconnect said swash plate impeller blade with said first and second piston means, each said split ball bearing means being structured to receive said periphery of said swash plate impeller blade, further each said split ball bearing means being structured to swivel as said impeller blade rotates in relation to said first and second piston means.

18. The rotary piston internal combustion engine of claim 17, wherein each of said split ball bearing means of said first and second piston means include each of said first and second piston means having a threaded aperture and one part of each said split ball bearing means having a threaded portion, said one part of each of said split ball bearing means being threadingly received into said threaded aperture of each respective said first and second piston means for adjusting said split ball bearing means of each respective said first and second piston means relative to said swash plate impeller blade.

* * * * *

UNITED STATES PATENT AND TRADEMARK OFFICE

CERTIFICATE OF CORRECTION

PATENT NO. : 4,886,024

DATED : December 12, 1989

INVENTOR(S) : Harold M. Meredith

It is certified that error appears in the above-identified patent and that said Letters Patent is hereby corrected as shown below:

Column 1, line 38, delete "presett" and insert ---- present ----.

Column 8, line 67, delete "86" and insert ---- 85 ----.

Column 9, line 32, delete "cut-off" and insert ---- cutoff ----.

Column 10, line 2, before "rearward" insert ---- the ----.

Column 10, line 30, delete "cut-off".

Column 12, after line 5, insert ---- means for transferring said combustible gas to said combustion chamber during formation of said combustion chamber; ----.

Column 12, line 6, delete "transferring" and insert ---- combusting ----.

Column 12, line 8, after "force" insert ---- imparting a rotary motion ----.

Column 12, line 35, after "connected" insert ---- fixedly ----.

Column 13, line 15, delete "chambers form" and insert ---- chamber forms ----.

UNITED STATES PATENT AND TRADEMARK OFFICE

CERTIFICATE OF CORRECTION

PATENT NO. : 4,886,024

DATED : December 12, 1989

INVENTOR(S) : Harold M. Meredith

It is certified that error appears in the above-identified patent and that said Letters Patent is hereby corrected as shown below:

Column 14, line 40, delete "pistons" and insert ---- piston means

Column 14, line 42, delete "pate" and insert ---- plate ----.

Column 15, line 68, delete "cylinder" and insert ---- cylindrical

Column 16, line 29, delete "complete" and insert ---- piston ----.

Column 16, line 41, delete "cylinder" and insert ---- cylindrical

Column 16, line 57, delete "location" and insert ---- locations

Column 18, line 14, before "impeller" insert ---- swash plate

Signed and Sealed this

Twenty-sixth Day of February, 1991

*Attest:*

HARRY F. MANBECK, JR.

*Attesting Officer*

*Commissioner of Patents and Trademarks*